US005735462A

United States Patent [19]

Roman

[11] Patent Number: 5,735,462

[45] Date of Patent: Apr. 7, 1998

[54] DEVICE FOR THE TRANSMISSION OF MOTION TO AN OSCILLATING ARM OF AN IRRIGATION DEVICE

[75] Inventor: Gianfranco Roman, Pasiano, Italy

[73] Assignee: Claber S.p.A., Veneto, Italy

[21] Appl. No.: 580,334

[22] Filed: Dec. 28, 1995

[30] Foreign Application Priority Data

Jan. 3, 1995 [IT] Italy ..... MI950003 U

[51] Int. Cl.[6] ..... B05B 3/16

[52] U.S. Cl. ..... 239/242; 239/263.3; 239/264; 239/563

[58] Field of Search ..... 239/237, 240, 239/242, 255, 246, 264, 562, 563, 566, DIG. 1, 263.3

[56] References Cited

U.S. PATENT DOCUMENTS

| | | | |
|---|---|---|---|
| 1,517,664 | 12/1924 | Bergquist | 239/242 |
| 3,063,646 | 11/1962 | Ballard | 239/242 |
| 3,786,991 | 1/1974 | Ingham | 239/242 |
| 4,258,882 | 3/1981 | Hayes | 239/242 |
| 4,606,500 | 8/1986 | Mussler et al. | 239/242 |
| 4,877,185 | 10/1989 | Kufrin | 239/242 |
| 5,033,678 | 7/1991 | Borghese et al. | 239/242 |
| 5,098,020 | 3/1992 | Cooper et al. | 239/242 |
| 5,305,956 | 4/1994 | Wang | 239/242 |
| 5,350,115 | 9/1994 | Burnworth et al. | 239/242 |
| 5,511,727 | 4/1996 | Heren et al. | 239/242 |
| 5,562,247 | 10/1996 | Roman | 239/240 |

FOREIGN PATENT DOCUMENTS

| | | | |
|---|---|---|---|
| A-1 265 864 | 11/1961 | France . | |
| 3138477 | 5/1982 | Germany | 239/242 |
| WO-A-85 00304 | 1/1985 | WIPO . | |

*Primary Examiner*—Andres Kashnikow
*Assistant Examiner*—Lisa Ann Douglas
*Attorney, Agent, or Firm*—Nixon & Vanderhye PC

[57] ABSTRACT

An irrigation device has an arm which is rotatably fastened at its ends to a pair of side elements of the irrigation device, and from one of which elements there extends a driving shaft. The device comprises a cam substantially in the shape of a heart integral with the shaft, a connecting rod coupled to the cam by the of a pair of shoes that engage the perimeter of the cam in substantially diametrically opposite positions. The connecting rod is provided with a slot wherein a guide for the connecting rod is engaged integral with the cam, and a crank integral with arm. The connecting rod can be hinged to the crank in a plurality of positions substantially aligned along a radial direction lying in a plane orthogonal to the axis of rotation of the arm and placed at different distances from the axis of rotation.

7 Claims, 2 Drawing Sheets

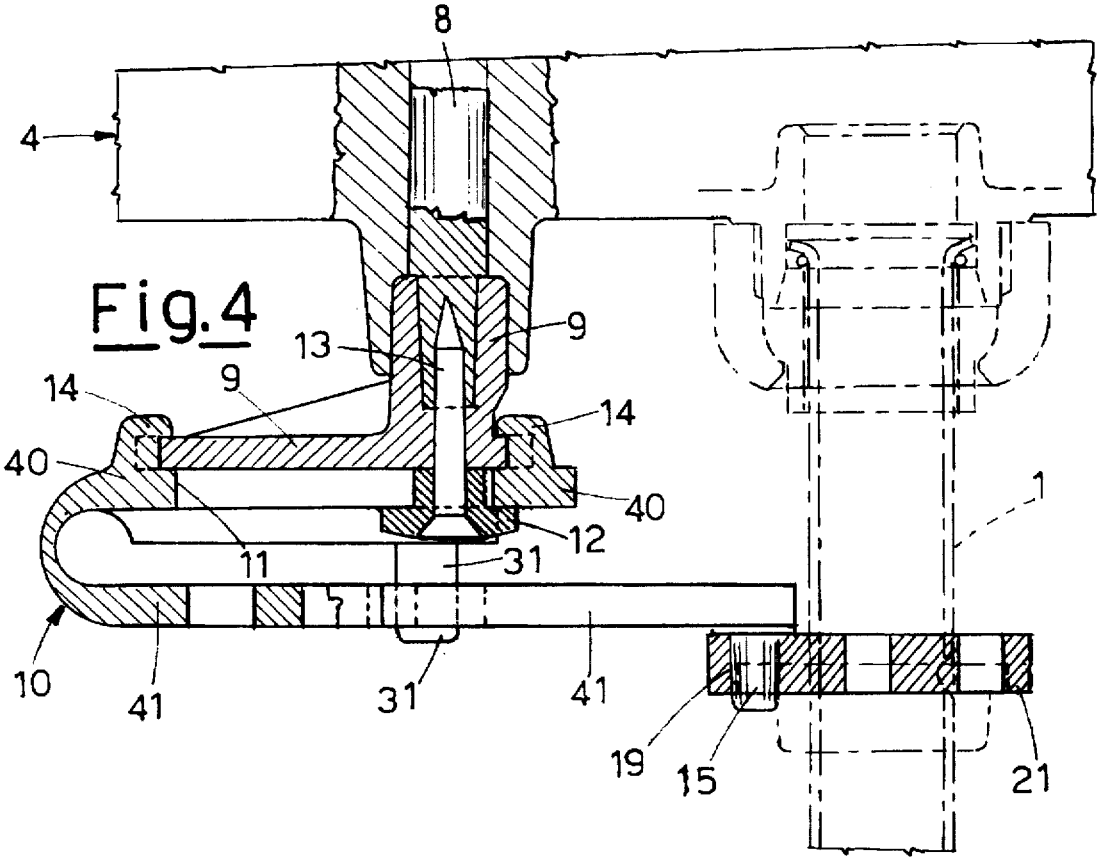
Fig. 4
Fig. 3
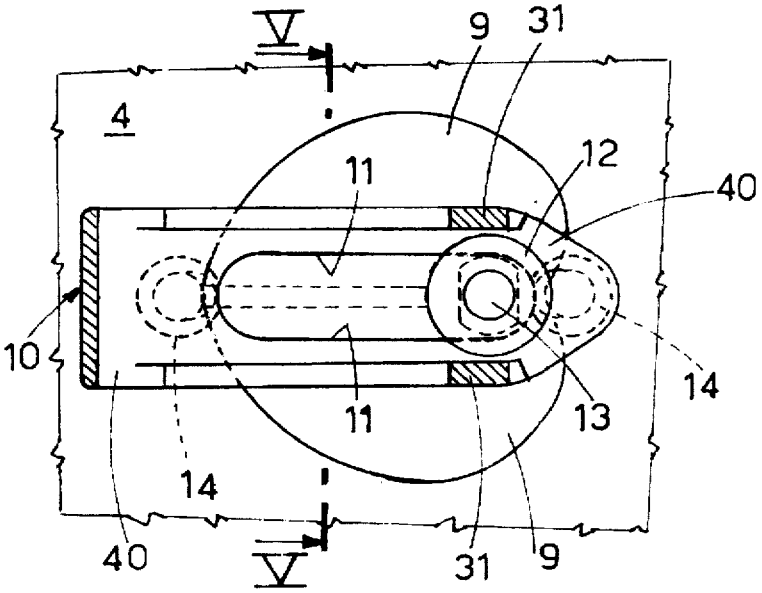
Fig. 5
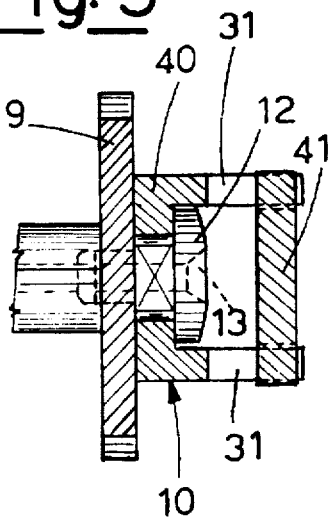

DEVICE FOR THE TRANSMISSION OF MOTION TO AN OSCILLATING ARM OF AN IRRIGATION DEVICE

BACKGROUND

I. Field of the Invention

The present invention relates to a device for the transmission of motion to an oscillating arm of an irrigation device.

II. Related Art and Other Considerations

In the sector of gardening articles, so-called irrigation devices with an oscillating arm are very widespread. Such devices typically have arm, internally hollow and provided with a plurality of nozzles from which the water issues. The arm is subjected to an oscillatory motion round an axis of rotation (coincident with the longitudinal axis of the arm itself), so as to irrigate a four-sided area of ground round the irrigation device.

The force driving the arm is supplied by the same flow of water that supplies the arm, by means of a rotor (housed in one element of the irrigation device) that places a driving shaft in continuous rotation. The continuous rotatory motion of the driving shaft is then transformed into the oscillatory motion of the arm by means of a transmission system with a connecting rod and crank.

A transmission system has already been known for some time comprising a cam in the shape of a heart integral with the driving shaft. A slotted link connecting rod is rotatably mounted on said cam and hinged at one end to a crank integral with the arm of the irrigation device (see U.S. Pat. No. 3,063,646 dated 13 Nov., 1962). The advantage that a system of this type exhibits with respect to other transmission systems is the reduced time during which the oscillating arm stops at the end-points of the oscillation, made possible by the particular conformation of the cam, something that translates into a very uniform oscillatory motion so that the ground all round the irrigation device is irrigated uniformly.

In the abovementioned U.S. Pat. No. 3,063,646 a system is also described for the manual setting of the end-points of the oscillation. The setting system comprises a knob for moving the point at which the connecting rod is hinged to the crank integral with the arm. By moving the knob, it is possible to displace such hinge point in a plurality of positions along a circumference. In this way, it is possible to vary the amplitude of oscillation of the arm of the irrigation device, and thus the extension of the four-sided area of irrigated ground.

However, since the hinge point moves along a circumference, the various positions that the hinge point can have correspond not only to variable amplitudes of oscillation, but also to variable degrees of symmetry of the oscillatory motion of the arm with respect to a vertical plane passing through the axis of the arm itself. This is a disadvantage, as it does not allow the amplitude of the oscillations to be varied in an exclusively symmetrical manner with respect to the vertical plane passing through the axis of the arm.

In view of the state of the art described, the object of the present invention is to provide a device for the transmission of motion to the oscillating arm of an irrigation device that allows the amplitude of the oscillations of the arm to be varied while keeping said oscillations symmetrical with respect to the vertical plane passing through the axis of the arm.

SUMMARY

According to the present invention, such object is achieved thanks to a device for the transmission of motion to an oscillating arm of an irrigation device. The arm is rotatably fastened at its ends to a pair of side elements of the irrigation device, from one of which there extends a driving shaft. The device comprises a cam substantially in the shape of a heart integral with said shaft, a connecting rod coupled to the cam by means of a pair of shoes that engage the perimeter of the cam in substantially diametrically opposite positions. The connecting rod is provided with a slot wherein guide means of the connecting rod are engaged integral with the cam, and a crank integral with the arm. The connecting rod can be hinged to the crank in a plurality of positions substantially aligned along a radial direction lying in a plane orthogonal to the axis of rotation of the arm and placed at different distances from said axis of rotation.

Thanks to a device according to the present invention, when the hinge point of the connecting rod is moved among the plurality of positions aligned along the radial direction, it is possible to vary the amplitude of the oscillations of the arm of the irrigation device, while still keeping the symmetry of said oscillations with respect to the vertical plane passing through the axis of the arm.

Provision is also made for further lateral hinge positions displaced on one side and on the other with respect to the positions radially aligned and arranged along at least one circumference lying in the abovementioned orthogonal plane and having center on the axis of rotation of the oscillating arm.

It is thus possible to obtain amplitudes of oscillation that are asymmetrical with respect to the vertical plane passing through the axis of the arm.

BRIEF DESCRIPTION OF THE DRAWINGS

The features of the present invention will be made more evident by the following detailed description of an embodiment thereof, illustrated as a non-limiting example in the enclosed drawings, wherein:

FIG. 3 is a cross-sectional view taken along the line III—III of FIG. 1;

FIG. 4 is a cross-sectional view taken along the line IV—IV of FIG. 2;

FIG. 5 is a cross-sectional view taken along the line V—V of FIG. 3.

DESCRIPTION OF THE PREFERRED EMBODIMENTS

Figure 1:
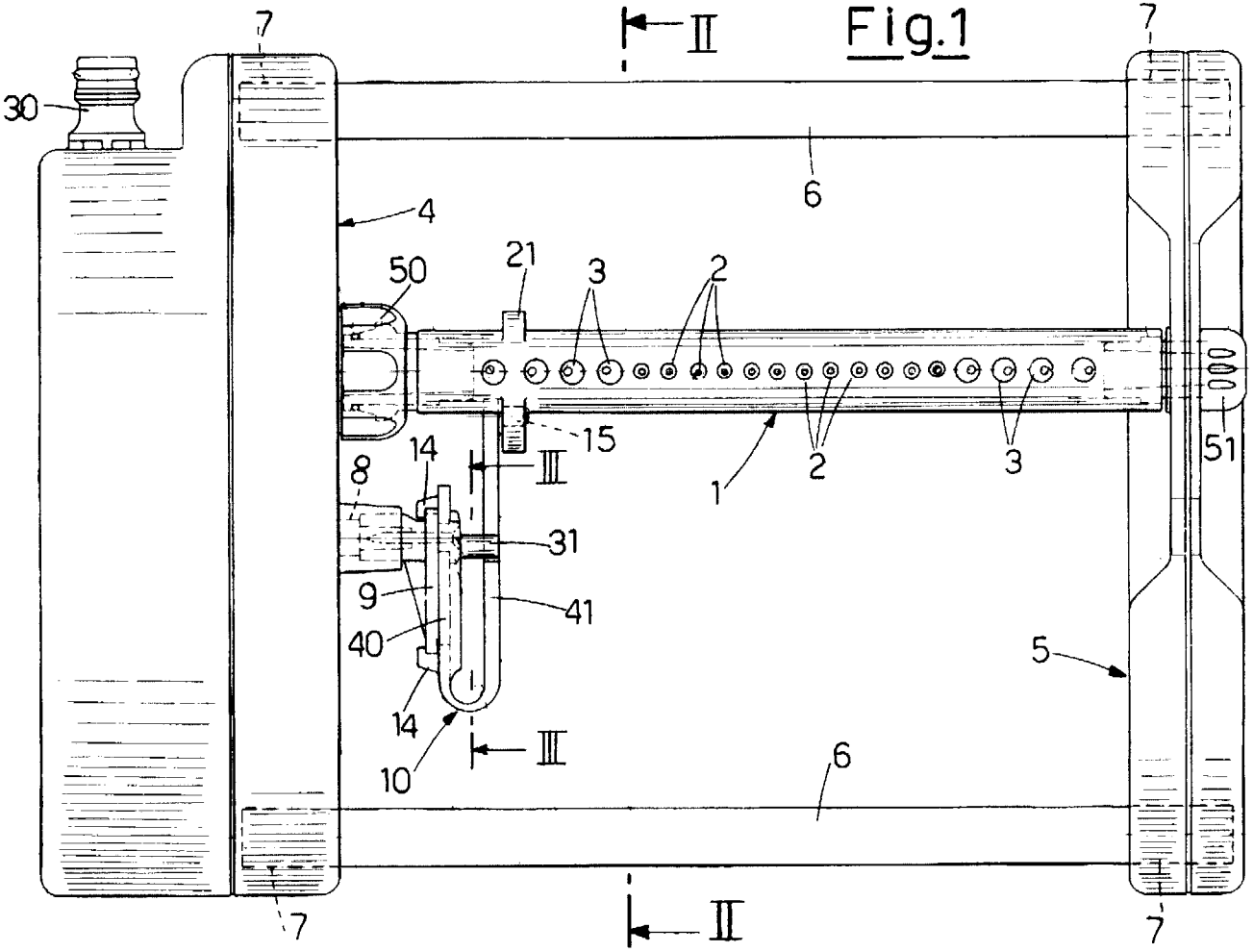
FIG. 1 is a plan view from above of an irrigation device with an oscillating arm provided with a device for the transmission of motion according to the present invention.

As shown in FIG. 1, an irrigation device with an oscillating arm comprises an arm 1, substantially a hollow cylinder, provided with a plurality of holes 2 from which the water issues. In some of the holes 2 there are nozzles 3 to obtain jets of water in a given direction. Such nozzles can be removed to change (reduce) the irrigated area. In the embodiment shown here, the arm 1 is rectilinear; but the arm 1 could also be curved.

The arm 1 extends between two side elements 4 and 5, to which it is rotatably fastened, by means of a ring nut 50 and a plug 51, respectively. The two side elements 4 and 5 are also connected by two stems 6, inserted under pressure in holes 7 in the elements themselves.

Figure 2:
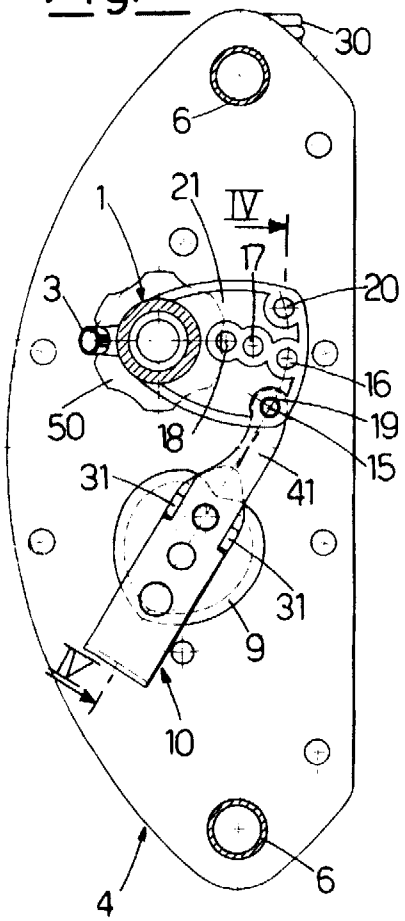
FIG. 2 is a cross-sectional view taken along the line II—II of FIG. 1.

Inside the side element 4 there is housed a turbine rotor (not visible in the drawings) that is driven by the water entering the element through a mouth 30 (to which a supply conduit is connected). The rotor drives a driving shaft 8, on which there is keyed a cam 9 substantially in the shape of a heart (FIGS. 2 and 3).

On cam 9 there is fitted a connecting rod 10, comprising an element formed of in synthetic material stamped in a "U-type" shape, so as to define two arms 40, 41. In a first arm 40 there is obtained an oblong opening 11, substantially a slot, wherein there is inserted a washer 12 having a circular head with a diameter larger than the transversal dimension of the slot 11 (FIG. 3). In the washer 12 there is inserted a screw 13 that connect the washer 12 with the shaft 8. The washer 12, engaging the slot 11, acts as a guide for the movement of the connecting rod 10. The first arm 40 of the connecting rod 10 has two shoes 14 in diametrically opposite positions, conformed so as to embrace the cam 9. First arm 40 of the connecting rod 10 also has a pair of brackets 31 that extend toward the second arm of the connecting rod 10, embracing it from both sides so as to keep the two arms 40, 41 aligned (FIGS. 4 and 5).

At the end of the second arm 41, the connecting rod 10 is provided with a pin 15 that can be inserted in one of five holes 16–20 drilled in a crank 21 integral with the arm 1. Three holes 16–18 are substantially aligned along a direction lying in a vertical plane orthogonal to the axis of rotation of the arm 1, and are placed at different distances from the axis of rotation. The two remaining holes 19 and 20 are located on opposite parts with respect to the row of holes 16–18, along a circumference with center at the point of intersection of the axis of rotation of the arm with the orthogonal vertical plane.

When the irrigation device is supplied with water (through the mouth 30), the rotor is operated, and as a consequence the shaft 8 is placed in continuous rotation. The cam 9 rotates integrally with shaft 8. The rotatory motion of cam 9 imparts to connecting rod 10 (the end of arm 41 of which is constrained to describe an arc of a circumference with center on the axis of rotation of arm 1) a substantially translatory harmonic motion, determined by the action of cam 9 on shoes 14. Washer 12, that is engaged in slot 11, acts as a guide for the substantially rectilinear sliding motion of connecting rod 10. The translatory harmonic motion of connecting rod 10 imparts to crank 21, and as a consequence to arm 1, an oscillatory motion round the axis of rotation of arm 1.

If the pin 15 is inserted in hole 16, the amplitude of the oscillations of arm 1 is the smallest possible, and the oscillation is symmetrical with respect to the vertical plane passing through the axis of rotation of arm 1. When pin 15 is moved to holes 19 or 20, the amplitude of the oscillations does not vary, but it is possible to make the oscillations asymmetrical with respect to the vertical plane, with a longer time period during which arm 1 remains on either one side or the other of the plane.

But if pin 15 is moved to hole 17, the amplitude of the oscillations increases, while the oscillation still remains symmetrical with respect to the vertical panel. A further increase in the amplitude of the oscillations can be obtained by moving pin 15 to hole 18, while still keeping the symmetry of the oscillations with respect to the vertical plane.

The device according to the present invention can be used with irrigation devices wherein the oscillating arm contains inside it a freely rotatable cylindrical element provided with a groove, e.g. helical, for the passage of water. Such an oscillating arm is described in simultaneously-filed U.S. patent application Ser. No. 08/580,334 in the name of the same applicant. The cylindrical element, rotating under the thrust of the water, periodically closes and opens the holes 2 of the arm.

I claim:

1. A device for the transmission of motion to an oscillating arm of an irrigation device, said arm being rotatably fastened at its ends to a pair of side elements of the irrigation device, from one of which there extends a driving shaft, comprising a cam substantially in the shape of a heart secured to said shaft, a connecting rod coupled to said cam by a pair of shoes that engage the perimeter of said cam in substantially diametrically opposite positions, the connecting rod being provided with a slot wherein a guide for the connecting rod is secured to said cam, and a crank secured to said arm, characterized in that said connecting rod can be hinged to said crank in a plurality of positions substantially aligned along a radial direction lying in a plane orthogonal to the axis of rotation of the arm and placed at different distances from said axis of rotation.

2. A device according to claim 1, characterized in that said connecting rod can also be hinged to said crank in further positions displaced on one side and on the other with respect to said positions radially aligned and arranged along at least one circumference lying in said orthogonal plane and having its center on the axis of rotation of the arm.

3. A device according to claim 2, characterized in that said positions are defined by respective holes for the insertion of a pin integral with said connecting rod.

4. A device according to claim 1, characterized in that said guide means said guide means comprises a washer integral with said cam and housed in said slot, said washer having a circular head with a diameter larger than the transversal dimension of the slot.

5. A device according to claim 1, characterized in that the connecting rod is folded down to form a "U", and comprises a pair of brackets extending from a first arm of said "U" to a second arm so as to embrace the latter on both its sides.

6. A device according to claim 1, characterized in that the arm comprises a cylindrical element inserted in the arm in a freely rotatable manner for periodically closing and opening the holes through which the irrigation liquid issues.

7. A device according to claim 1, characterized in that said connecting rod can be hinged to said crank in a plurality of positions defined by respective holes in the crank, the plurality of positions including three positions substantially aligned along the radial direction and three positions arranged in an arc on the crank.

* * * * *

UNITED STATES PATENT AND TRADEMARK OFFICE

CERTIFICATE OF CORRECTION

PATENT NO. : 5,735,462
DATED : April 7, 1998
INVENTOR(S) : Gianfranco Roman

It is certified that error appears in the above-identified patent and that said letters patent is hereby corrected as shown below:

Cover page item [73] should read -- Claber S.p.A., Fiume Veneto, Italy --

Signed and Sealed this

Fourteenth Day of July, 1998

*Attest:*

BRUCE LEHMAN

*Attesting Officer*

*Commissioner of Patents and Trademarks*